US007048830B2

(12) United States Patent
Heger et al.

(10) Patent No.: US 7,048,830 B2
(45) Date of Patent: May 23, 2006

(54) PAPER-MAKING MACHINE WIRE CLOTH

(75) Inventors: Wolfgang Heger, Nideggen (DE); Klaus Fichter, Juchen (DE)

(73) Assignee: Andreas Kufferath GmbH & Co. KG, Düren (DE)

( * ) Notice: Subject to any disclaimer, the term of this patent is extended or adjusted under 35 U.S.C. 154(b) by 17 days.

(21) Appl. No.: 10/472,829

(22) PCT Filed: Apr. 24, 2002

(86) PCT No.: PCT/EP02/04471

§ 371 (c)(1),
(2), (4) Date: Sep. 25, 2003

(87) PCT Pub. No.: WO02/092907

PCT Pub. Date: Nov. 21, 2002

(65) Prior Publication Data

US 2004/0089365 A1 May 13, 2004

(30) Foreign Application Priority Data

May 12, 2001 (DE) ..... 101 23 204

(51) Int. Cl.
*D21F 1/10* (2006.01)
*D03D 3/02* (2006.01)

(52) U.S. Cl. ..... 162/348; 162/903; 139/383 A

(58) Field of Classification Search ..... 162/199, 162/348, 116, 117, 361, 358.2, 900, 902, 162/903; 139/383 A, 425 A; 28/110, 142

See application file for complete search history.

(56) References Cited

U.S. PATENT DOCUMENTS

| | | | | |
|---|---|---|---|---|
| 3,127,308 A | | 3/1964 | Justus et al. | |
| 4,314,589 A | * | 2/1982 | Buchanan et al. | 139/383 A |
| 4,499,927 A | * | 2/1985 | Borel | 139/425 A |
| 4,501,303 A | | 2/1985 | Österberg | |
| 4,569,375 A | * | 2/1986 | Borel | 139/383 A |
| 5,152,326 A | * | 10/1992 | Vohringer | 139/383 A |
| 5,454,405 A | * | 10/1995 | Hawes | 139/383 A |
| 6,223,780 B1 | | 5/2001 | Kaldenhoff | |

FOREIGN PATENT DOCUMENTS

| | | |
|---|---|---|
| DE | 3036409 | 5/1982 |
| EP | 0889160 | 1/1999 |

* cited by examiner

*Primary Examiner*—Eric Hug
(74) *Attorney, Agent, or Firm*—Roylance, Abrams, Berdo & Goodman, L.L.P.

(57) ABSTRACT

A paper-making machine wire cloth has an individual woven cloth for the paper side (12) and an individual woven cloth for the running side (14). Each woven cloth includes a set of weft threads (16;20) and warp threads (18;22). The diameters and the number of paper side and running side warp threads (18;22) are essentially equal. The paper side warp threads (18) and weft threads (16), together, form a weave. At least a portion of the running side threads (22) passes into the paper side (12), extends over the subsequent paper side weft thread (16) and, afterwards, returns to the running side (14) each time at a location (24), at which this warp thread (22) is located above at least one assigned running side weft thread (20). A marking-free paper side is achieved in the weave, while simultaneously improving the surface uniformity. A compact binding of the individual woven cloth is effected without the use of additional binding threads, largely avoiding a layer separation of the individual woven cloth or an offset of the same with regard to one another.

18 Claims, 3 Drawing Sheets

F
I
II
12
14
16
18
20
22
24
26
28
30
34
36
38

PAPER-MAKING MACHINE WIRE CLOTH

FIELD OF THE INVENTION

The present invention relates to a paper making machine wire cloth formed of an individual fabric for the paper side and an individual fabric for the backing side. Each fabric has one set of weft threads and warp threads. The diameter and the number of the paper side and backing side warp threads are more or less equal. The paper side warp threads and weft threads together form a linen weave.

BACKGROUND OF THE INVENTION

In the paper manufacturing industry, an increasing number of high-capacity paper machines with speeds of up to 2,000 m/min and operating widths exceeding 10 m are used. As a general rule, the sheet forming unit is configured as a double-cloth former, and in many cases, as a split former. In such machines, the sheet forming process takes place immediately between two paper making cloths in a relatively short drainage zone. Because of this short distance and the high production speed, the time for sheet forming is reduced to a few milliseconds. The solid component or dry content of the fiber suspension must be increased from about 1 percent to approximately 20 percent. The significance for the paper making wire cloths is that they must possess a very high drainage capacity, and yet leave no marks in the paper while providing high fiber support.

Another important point is the transverse stability of the cloth tension, which stability is important for the uniformity of the thickness and water content profile of the paper web. The requirements set in this connection have a very high precision in the case of modern machines with large operating widths. Forming strips, which are mounted alternately on the backing sides of the cloths and are pressed against them, are now used in the sheet forming zone with increasing frequency to improve formation. This arrangement results in rapidly changing bowing of the covering of the wire cloths in the longitudinal direction.

At present, an effort is usually made to meet these requirements by using composite fabrics. One composite fabric used for the purpose is described, for example, in DE 42 29 828 C2. The conventional paper making machine wire cloth used for the purpose has two stacked cloth fabrics which make up at least one layer and are interconnected by binding threads extending in the transverse and/or longitudinal directions. One of the cloth fabrics is configured as a definition fabric having the mechanical properties of the composite fabric with respect to extension and rigidity. The other cloth fabric is configured as a reaction fabric characterized by greater extension and lower rigidity than the definition fabric. The cloth fabrics are formed of warp and weft threads, these threads being interconnected by additional binding threads. Internal wear, especially wear of the binding threads, is counteracted to increase the service life of the composite fabric. Undesirable separation of the cloth fabric layers is prevented over a longer period as a result of design of the cloth fabric layers as reaction and definition cloths. The internal wear of a composite fabric is due particularly to the circumstance that the individual cloth fabric layers are stretched or buckled to a varying extent during reversals of the wire cloth, as occur in the area of guide rollers or wire section over which the composite cloth is guided.

Since the binding threads do not belong to the fabric structure, but rather are independent components, they are kept thin in diameter to disrupt the drainage as little as possible. When suitable high stresses occur, the possibility exists that the thin binding threads will split and the connection between the cloth fabrics will be lost. In the case of a generic paper making machine wire cloth as specified in EP 0 432 413 B1, which also is configured as a composite fabric, two threads of the fabric itself can be used and can be woven into the other fabric layer to form X-shaped intersections in order to avoid the disadvantages of the state of the art as described. However, undesirable stiffening of the fabric results from the accumulation itself of the intersections in the transverse direction. Significant differences in length may occur especially over longer weaving lengths. These differences may in turn be expressed in differences in tension, with the result that the binding threads specific to the cloth may also break and may result in failure of the conventional paper making machine wire cloth. In addition, with this conventional special weave, it is more or less possible only to process transverse threads of one type, that is, transverse threads with more or less the same diameter compositions. This limitation reduces the possibility of effective support on the backing side. Production of the conventional composite fabrics as described is also costly.

EP 0 698 682 A1 discloses a fabric formed of a system of face wefts, back wefts, and warps, the latter being made up of a system pair of first and second types of warp threads. The warp threads of the first type are interwoven with the face wefts and, at predetermined distances, intermittently with the back wefts. Warp threads of the second type extend between the face and back wefts, and bind with the face wefts at the point at which the first warp thread belonging to the pair binds with the back weft. Consequently, the warp threads are then positioned one directly above the other, except at the point at which the second warp threads bind with the face weft. As a result of this proximate state of the art, in the case of a paper making machine wire cloth, while surface uniformity on the paper side is improved, separation of the layers or shifting of the layers of fabric in relation to each other cannot be completely excluded.

SUMMARY OF THE INVENTION

Objects of the present invention are to provide improved paper making machine wire cloths having longer service lives with the same quality scales for paper manufacture and being cost effective in production.

These objects are basically attained by a paper making machine wire cloth having at least one part of each backing side warp thread positioned at a point at which this warp thread is above at least one associated backing side weft thread. That one part changes to the paper side, extends over the following paper side weft thread, and then returns to the backing side. A paper side free of marking is achieved in the case of linen weave, along with improvement in the surface uniformity. In addition, a compact bond of the individual fabrics without additional binding threads is obtained in this way. Separation of the layers of the individual fabrics or shifting of these layers relative to each other is largely excluded. Consequently, long service lives accompanied by high production quality can be achieved in paper production by the paper making machine wire cloth of the present invention. Production of the paper making machine wire cloth cost effective, as well.

One preferred embodiment of the paper making machine wire cloth of the present invention is characterized in that a minimum of four associated backing side weft threads support the change position in the area of change of the backing side warp thread from the backing side to the paper side and from the paper side back to the backing side. Something may be used on the backing side of the weft threads, which result in high transverse stability within the fabric bond and form a corresponding volume of abrasion, to increase the service life of the paper making machine wire cloth. Preferably, the linen weave is designed as a longer floating weave to improve the surface uniformity in paper production.

In one especially preferred embodiment of the paper making machine wire cloth of the present invention, a backing side weft thread is mounted between the four backing side weft threads making up a first group and a second group with two backing side weft threads in the direction of the paper side warp thread above a backing side warp thread. This backing side weft thread supports a paper side weft thread over which the paper side warp thread is guided. The support points thus formed yield a high degree of stability in relation to the two individual fabric layers of the wire cloth under consideration.

The direction of support preferably is designed to extend from the paper side and backing side transversely to the planes of lower and upper fabrics. As an alternative, the direction of support can extend in an alternating diagonal arrangement in relation to the fabrics. As a result of the diagonal arrangement selected, the supporting forces are introduced into the lower fabric so that separation of the layers or displacement of the fabrics can definitely be effectively countered. The latter applies in particular if, with the support configuration extending diagonally, the consecutive weft threads of the paper side are spaced a greater distance from each other than the associated supporting weft threads of the backing side.

BRIEF DESCRIPTION OF THE DRAWINGS

Referring to the drawings which form a part of this disclosure:

FIGS. 8 and 9 are side elevation views of the first embodiments shown in FIGS. 1 to 4 with a pick ratio of 1:1, in which the weft sequence is repeated after 16 picks or in which one weft sequence with tie-in is interrupted by a weft sequence without tie-in.

DETAILED DESCRIPTION OF THE INVENTION

Figures 1, 2, 3, 4:
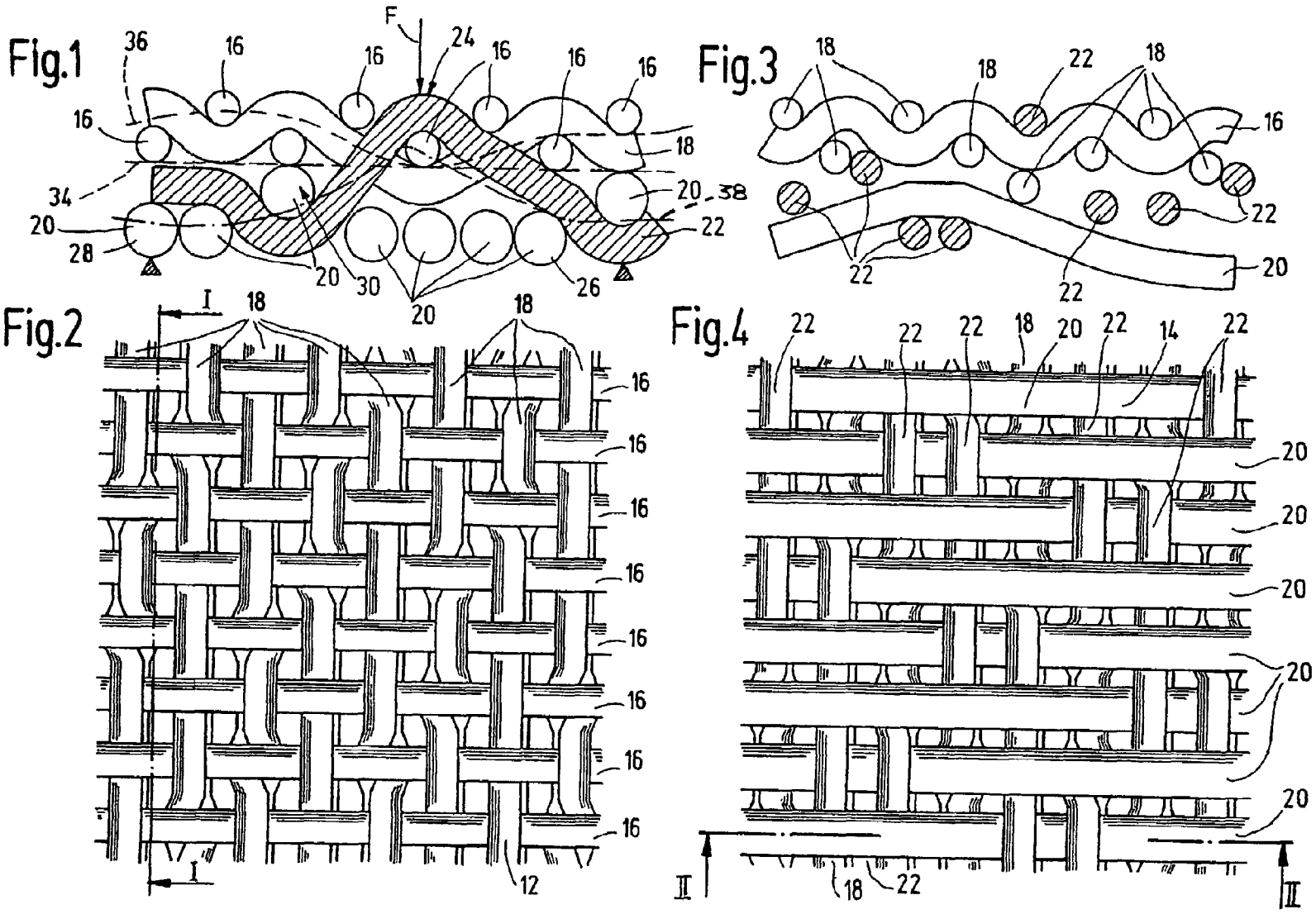
FIG. 1 is a side elevational view in section taken along line I—I of FIG. 2 of a paper making machine wire cloth according to a first embodiment of the present invention.
FIG. 2 is a top plan view of the paper side of a paper making machine cloth according to of the first embodiment with a pick ratio of 1:1.
FIG. 3 is a side elevational view in section taken along line II—II of FIG. 4 of a paper making machine cloth according to the first embodiment, the backing side being on the bottom.
FIG. 4 is a bottom plan view of the backing side of a paper making machine wire cloth according to the first embodiment.

The figures described above show to some extent differing embodiments of portions of cloth fabrics for a paper making machine wire cloth. The wire cloth may be used in particular for the so-called sheet-forming zone in conventional paper manufacturing machines. The cloth fabric if formed of an individual fabric for the paper side 12 and an individual fabric for the backing side 14. The paper side 12 includes a set of weft threads 16 and warp threads 18. The backing side 14 as well includes of a set of weft threads 20 and warp threads 22. As seen particularly in FIGS. 8, 9, and 10, the paper side warp threads 18 and the associated weft threads 16 together form a linen weave. Also as illustrated, the diameters and the number of the paper side and backing side warp threads 18, 22 are more or less the same (i.e., are substantially equal). The backing side warp thread 22 moves at a change point, identified as a whole by 24, from the backing side 14 to the paper side 12 and then returns to the backing side 14. In the area of this change of the backing side warp thread 22 from the backing side 14 to the paper side 12 and from it back to the backing side 14, the change point 24 is supported by four weft threads 20 adjacent one another in one plane. In addition, between these four backing side weft threads 20 forming a first group 26 and a second group 28 having two backing side weft threads 20 in the direction of the paper side warp thread 18 above a backing side warp thread 22, a backing side weft thread 20 supports a paper side weft thread 20 which supports a paper side weft thread 16 over which the paper side warp thread 18 is guided.

Figure 5:
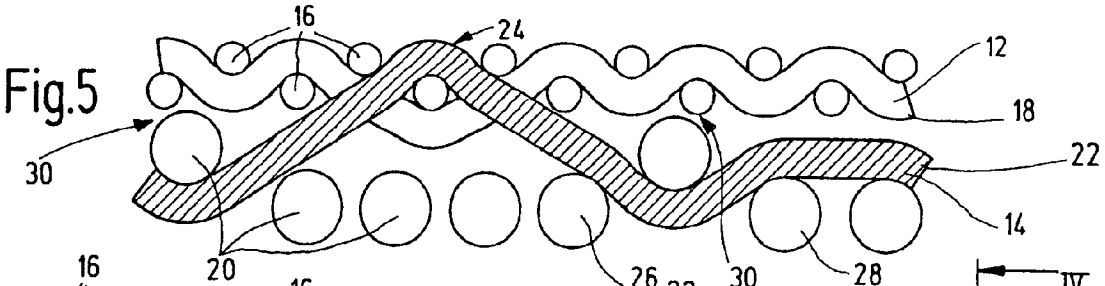
FIG. 5 is a side elevation view in section along line III—III of FIG. 6 and along line IV—IV of FIG. 7 of a paper making machine wire cloth according to a second embodiment of the present invention.
Figure 7:
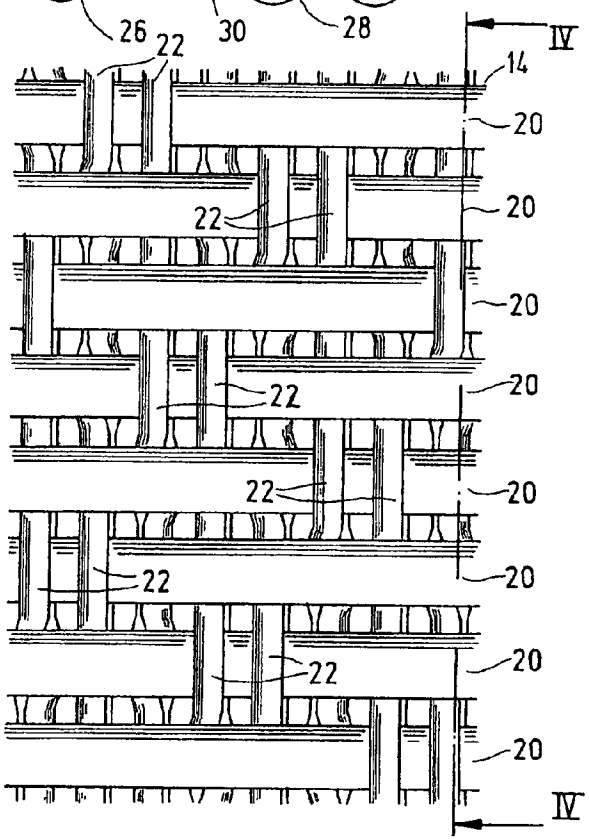
FIG. 7 is a bottom plane view of the backing side of a paper making machine wire cloth according to the second embodiment.
Figure 6:
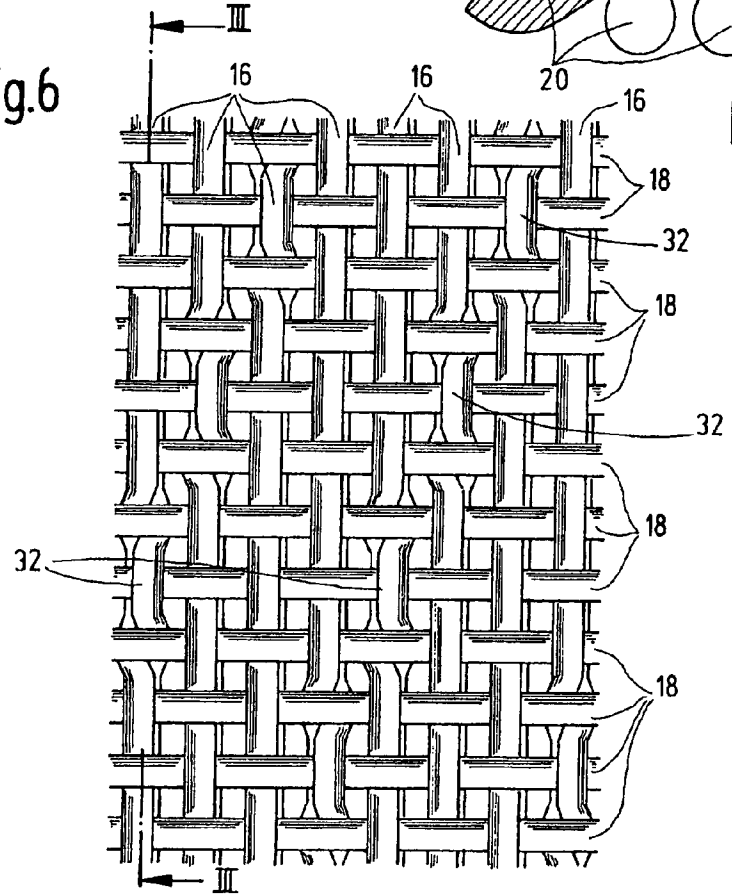
FIG. 6 is a top plan view of the paper side of a paper making machine wire cloth according to the second embodiment, with a pick ratio of 3:2.
Figure 8:
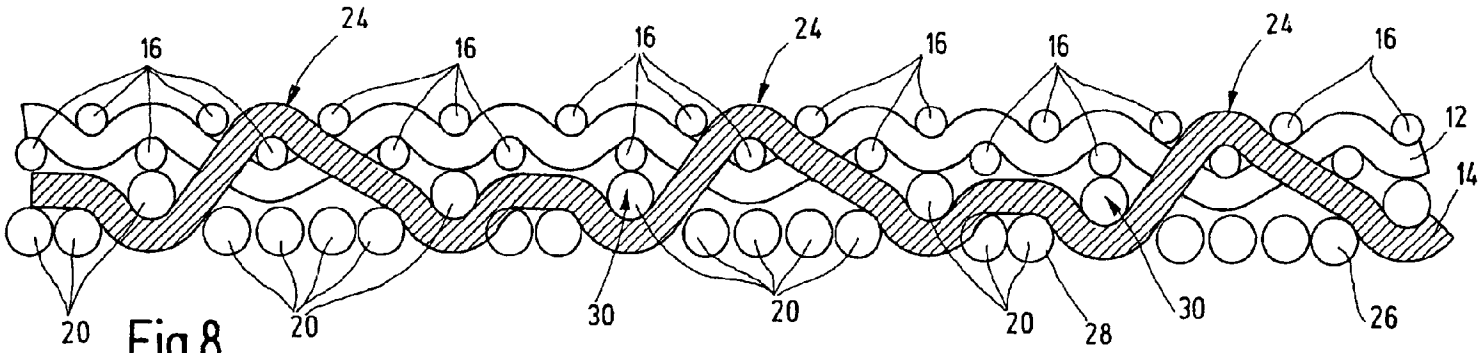
Figure 9:
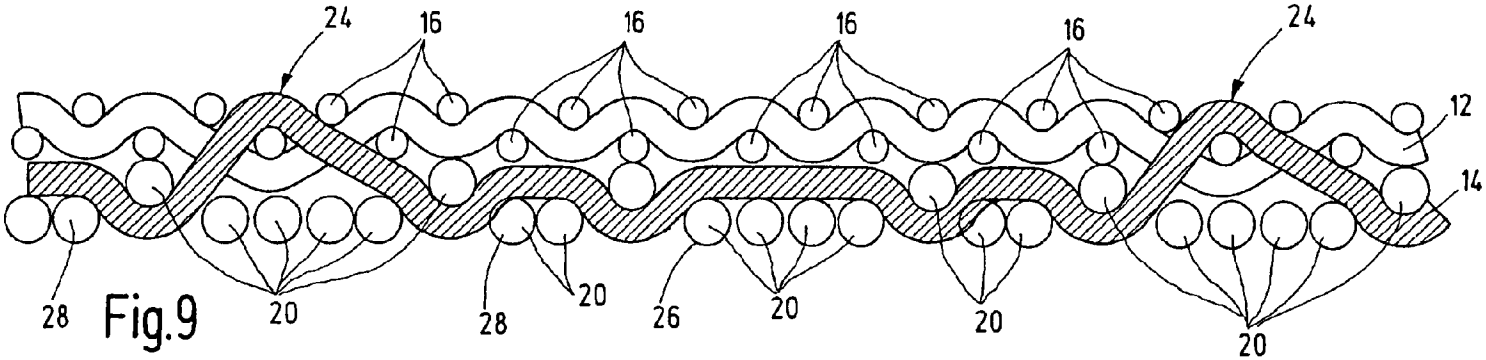
Figure 10:
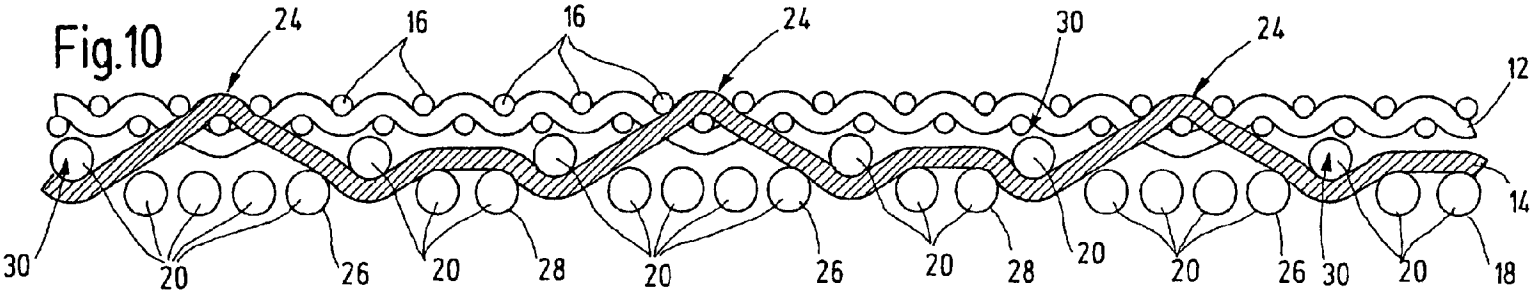
FIG. 10 is a side elevational view of the second embodiment shown in FIGS. 5 to 7 with a pick ratio of 3:2 (upper to lower weft), in which the weft sequence is repeated after 20 picks.

As is shown in FIGS. 1, 8, and 9, the direction of support may extend from paper side and backing side weft threads 16, 20 transversely to the planes of lower and upper fabrics in the form of the paper side 12 or the backing side 14. As is shown in FIGS. 5 and 10, however, the direction of support may extend in an alternating arrangement diagonal relative to the fabrics 12, 14. The decisive factor is that, for the purpose of forming a support point, identified by 30 as a whole, a paper side weft thread 16 thinner in cross-section is supported by a backing side weft thread 20 thicker in cross-section, and that the support point 30 is supported on top and on the bottom by the paper side warp threads 18 and the backing side warp threads 22 together. The respective support point 30 may be formed directly in that the weft threads 16 and 20 are stacked. However, as is shown in FIGS. 5 and 10, they may be constantly separated by a predetermined distance and optionally brought together only when a load is applied so as to make the support possible. In the case of a diagonally extending support layout in particular, the stacked weft threads 16 on the paper side 12 are spaced farther apart than the associated supporting weft threads 20 on the backing side 14.

The backing side warp and weft threads 20, 22 normally form a long-floating eight-shaft bottom in which the wefts are doubly tied in, that is, tied in by two adjacent warp threads. The bonding of paper side 12 to backing side 14 thus is such that the respective backing side warp thread 22 is in a predetermined position at which it changes by way of the four backing side weft threads 20 of the first group 26 to the paper side 12. On the paper side, it extends over the paper side weft 16. Since the linen weave normally does not have additional room to accommodate this changing warp thread 22, and since it would then close the respective mesh, the paper side warp thread 18 is at the same time eliminated from the top side and extends, as is shown in the partial diagram in FIG. 1, under three paper side weft threads 16.

As a result, the backing side fabric 14 is bonded to the paper side 12. Since the paper side warp extends below the top side at the respective tie-in point, the backing side warp assumes the function of filling out the paper side surface along with that of effecting tie-in. The paper side structure is maintained to the greatest extent possible, as is shown in FIG. 2 in particular. Since the rise of the backing side bond to the tie-in points 32 is absorbed in the paper side 12, the tie-in points 32, as is shown in part in FIG. 2, are distributed evenly in the repeat pattern. The respective tie-in points 32 accordingly ensure that the structure of the lower fabric, that is, the backing side 14, is not harmfully altered. In addition, the double tie-in of the backing side wefts increases the stability of the fabric as a whole as relative to diagonal shifting, which occurs when the tensile load is unevenly distributed over the width of the fabric. Such uneven distribution occurs especially with great machine widths, for which it cannot always be ensured that the driving and frictional forces will occur uniformly over the entire width. The point is then reached at which the wire cloth may be warped to some extent. In the worst case, this warping results in reduction of the width of the wire cloth and accordingly to rendering the paper making machine wire cloth unserviceable.

During production, as well as during running of a paper making machine wire cloth, the longitudinal threads 18, 22, that is, the warps, are subject to tensile loading. In a normal linen weave, the forces applied in different directions are equalized by the inversely juxtaposed warp threads, so that a resultant force arises in the plane of the fabric and no uneven deformations of the surface occur. However, if a face weft is woven with the backing warp, as is the case with the paper making machine wire cloth of the present invention, a vertical force component is added. Such vertical force component can only inadequately be equalized by the paper side wefts and the upper warps extending beside them. The lower warp then pulls the upper weft into the fabric, and the paper side is dented. Application of the layer bonding of the present invention prevents the possibility of longitudinal bends of the fabric in the paper machine resulting in displacement of the two individual fabrics, and accordingly, in inner wear accompanied by ultimate layer separation. The neutral bending line 34 is shown in FIG. 1, along with the bending line 36 of the upper fabric and the bending line 38 for the lower fabric. The bending force introduced into the paper making machine wire cloth, indicated by an arrow marked F, is also shown in FIG. 1. The corresponding fixed supports in the lower fabric are represented by two stylized triangular supports. FIG. 1 also makes it clear that when bending force F is applied to the change point 24 by junction of the three bending lines 34, 36, 38 in the area of the paper side weft thread 16 positioned below the point of application of the force and is absorbed between the warp threads 18 and 22, a sort of articulated or desired bending point is formed which counteracts separation of the layers.

The bonding concept of the present invention may be applied to the widest variety of weft relationships of upper fabric to lower fabric, with the result that the properties of the cloths with respect to openness (drainage capacity), stability, and volume of abrasion (transit time) may be adapted to the greatest extent possible to meet the particular requirements of the paper machine. Virtually any distribution of the frequency and setting of the tie-in points 32 and so optimization of the strength of the bond may be effected by the weft sequence. In contrast, if the bonding is carried out in the transverse direction, as is reflected in conventional paper making machine wire cloths, a limit is imposed by the finite number of shafts.

FIG. 8 presents, as an example, a section of a paper making machine wire cloth with a pick ratio of 1:1. The weft sequence is repeated after 16 picks. In the exemplary embodiment shown in FIG. 9, a weft sequence with a tie-in is interrupted by a weft sequence without a tie-in. The warp threads positioned adjacent to them in one plane are overlapped so that uniform distribution is still maintained. In the exemplary embodiment as shown in FIG. 10, a pick ratio of 3:2 is provided, in which the weft sequence is repeated after 20 picks. The exemplary embodiments discussed in the foregoing represent only a part of the potential variety and application for the paper making machine wire cloth of the present invention.

While various embodiments have been chosen to illustrate the invention, it will be understood by those skilled in the art that various changes and modifications can be made therein without departing from the scope of the invention as defined in the appended claims.

What is claimed is:

1. A paper making machine wire cloth, comprising:

a paper side;

a backing side;

an individual paper side fabric with a set of paper side weft threads and warp threads;

an individual backing side fabric with a set of backing side weft threads and warp threads, said paper side and backing side warp threads being substantially equal in diameter and number, said paper side warp threads and weft threads forming an interconnected linen weave;

at least one part of each of said backing side warp threads being positioned at a change point where the respective backing side warp thread extends from said backing side by at least one respective backing side weft thread to said paper side, extends over a following paper side weft thread and returns to said backing side;

at least four adjacent backing side weft threads support said change point of each said backing side warp thread; and one of said backing side weft threads supporting a paper side weft thread over which one of paper side warp threads is guided and being mounted between said four adjacent backing side weft threads forming a first group, and two of said backing side weft threads forming a second group in a direction of said one paper side warp threads above one of said backing side warp threads.

2. A paper making machine wire cloth according to claim 1, wherein said linen weave is a floating weave.

3. A paper making machine wire cloth according to claim 1, wherein said one of said backing side weft threads supports the respective paper side weft thread in a direction extending transversely to planes of said paper side and said backing side fabrics.

4. A paper making machine cloth according to claim 1, wherein said one of said backing side weft threads supports the respective paper side weft thread in a direction extending diagonally relative to said fabrics in alternating arrangements.

5. A paper making machine cloth according to claim 4, wherein consecutive ones of said paper side weft threads are spaced a greater distance from one another than adjacent backing side weft threads.

6. A paper making machine cloth according to claim 1, wherein an odd number of said paper side weft threads are always positioned between two change points of each said backing side warp thread.

7. A paper making machine wire cloth according to claim 1, wherein weft sequences with change points are interrupted by weft sequences without change points.

8. A paper making machine wire cloth according to claim 1, wherein said backing side weft threads have greater cross-sectional diameters that said paper side weft threads adjacent thereto.

9. A paper making machine wire cloth according to claim 1, wherein bending lines of said paper side fabric and said backing side fabric and a neutral bending line converge at said change point to form a link point counteracting layer separation.

10. A paper making machine wire cloth comprising:

a paper side;

a backing side;

an individual paper side fabric with a set of paper side weft threads and warp threads, an individual backing side fabric with a set of backing side weft threads and warp threads, said paper side and backing side warp threads being substantially equal in diameter and number, said paper side warp threads and weft threads forming an interconnected linen weave;

at least one part of each of said backing side warp threads being positioned at a change point where the respective backing side warp thread extends from said backing side by at least one respective backing side weft thread to said paper side, extends over a following paper side weft thread and returns to said backing side; and weft sequences with change points are interrupted by weft sequences without changes points.

11. A paper making machine wire cloth according to claim 10, wherein at least four adjacent backing side weft threads support said change point of each said backing side warp thread.

12. A paper making machine wire cloth according to claim 10, wherein said linen weave is a floating weave.

13. A paper making machine wire cloth according to claim 10, wherein said one of said backing side weft threads supports the respective paper side weft thread in a direction extending transversely to planes of said paper side and said backing side fabrics.

14. A paper making machine cloth according to claim 10, wherein said one of said backing side weft threads supports the respective paper side weft thread in a direction extending diagonally relative to said fabrics in alternating arrangements.

15. A paper making machine cloth according to claim 14, wherein consecutive ones of said paper side weft threads are spaced a greater distance from one another than adjacent backing side weft threads.

16. A paper making machine cloth according to claim 10, wherein an odd number of said paper side weft threads are positioned between two change points of each said backing side warp thread.

17. A paper making machine wire cloth according to claim 10, wherein said backing side weft threads have greater cross-sectional diameters than said paper side weft threads adjacent thereto.

18. A paper making machine wire cloth according to claim 10, wherein bending lines of said paper side fabric and said backing side fabric and a neutral bending line converge at said change point to form a link point counteracting layer separation.

* * * * *